US007158749B2

(12) United States Patent
Ueno et al.

(10) Patent No.: US 7,158,749 B2
(45) Date of Patent: Jan. 2, 2007

(54) CLEANING DEVICE, PROCESS CARTRIDGE, CLEANING MEMBER AND ELECTROPHOTOGRAPHIC IMAGE FORMING APPARATUS

(75) Inventors: Takahito Ueno, Shizuoka (JP); Atsushi Numagami, Kanagawa (JP); Isao Koishi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/957,701

(22) Filed: Oct. 5, 2004

(65) Prior Publication Data

US 2005/0238395 A1 Oct. 27, 2005

(30) Foreign Application Priority Data

Apr. 26, 2004 (JP) ..... 2004-129672
Apr. 28, 2004 (JP) ..... 2004-134643
Sep. 21, 2004 (JP) ..... 2004-274205

(51) Int. Cl.
*G03G 21/00* (2006.01)

(52) U.S. Cl. ..... 399/351; 399/350

(58) Field of Classification Search ..... 399/100, 399/123, 350, 351

See application file for complete search history.

(56) References Cited

U.S. PATENT DOCUMENTS 4,702,591 A * 10/1987 Tsuda et al. ..... 399/350 X
5,066,983 A * 11/1991 Tonomoto ..... 399/351 X
5,298,953 A * 3/1994 Lindblad et al. ..... 399/350 X
5,383,011 A 1/1995 Numagami et al.
5,500,714 A 3/1996 Yashiro et al.
5,543,898 A 8/1996 Shishido et al.
5,585,895 A 12/1996 Yashiro et al.
5,689,774 A 11/1997 Shishido et al. ..... 399/111
5,790,923 A 8/1998 Oguma et al. ..... 399/106
5,920,753 A 7/1999 Sasaki et al. ..... 399/111
5,937,239 A 8/1999 Watanabe et al. ..... 399/111
5,966,566 A 10/1999 Odagawa et al. ..... 399/109
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,097,909 A 8/2000 Watanabe et al. ..... 399/111
6,101,354 A 8/2000 Nakagawa et al. ..... 399/225
6,131,007 A 10/2000 Yamaguchi et al. ..... 399/256
6,137,973 A * 10/2000 Nishiuwatoko et al. . 399/350 X
6,169,866 B1 1/2001 Watanabe et al. ..... 399/111

(Continued)

FOREIGN PATENT DOCUMENTS

JP 6-095502 4/1994

(Continued)

*Primary Examiner*—Sandra L. Brase
(74) *Attorney, Agent, or Firm*—Fitzpatrick, Cella, Harper & Scinto

(57) ABSTRACT

A cleaning device used in an electrophotographic image forming apparatus includes a frame, an elastic blade contacting an electrophotographic photosensitive drum to remove a developer remaining thereon, a blade supporting member, and a removed developer containing portion containing the developer removed from the drum by the blade. The supporting member includes: a supporting portion attached to the frame for supporting the blade; a first bent portion bent from the supporting portion to an opposite side to an attachment surface where the supporting portion is attached to the frame; a connecting portion extending from the first bent portion to the opposite side in the orthogonal direction; a second bent portion bent from the connecting portion in the orthogonal direction and in a lateral direction of the supporting portion; and an extension portion extending from the second bent portion, in the orthogonal direction and in the lateral direction.

10 Claims, 9 Drawing Sheets

U.S. PATENT DOCUMENTS

| | | | | |
|---|---|---|---|---|
| 6,175,701 | B1 * | 1/2001 | Kwon | 399/350 X |
| 6,236,821 | B1 | 5/2001 | Yokoyama et al. | 399/113 |
| 6,246,848 | B1 | 6/2001 | Morinaga et al. | 399/106 |
| 6,246,849 | B1 | 6/2001 | Yokoyama et al. | 399/117 |
| 6,266,500 | B1 | 7/2001 | Numagami et al. | 399/104 |
| 6,272,299 | B1 | 8/2001 | Numagami et al. | 399/111 |
| 6,289,189 | B1 | 9/2001 | Numagami et al. | 399/111 |
| 6,330,409 | B1 | 12/2001 | Watanabe et al. | 399/111 |
| 6,442,359 | B1 | 8/2002 | Numagami et al. | 399/111 |
| 6,459,866 | B1 * | 10/2002 | Meguro | 399/350 X |
| 6,463,233 | B1 | 10/2002 | Kojima et al. | 399/111 |
| 6,577,831 | B1 | 6/2003 | Numagami et al. | 399/111 |
| 6,608,980 | B1 | 8/2003 | Murayama et al. | 399/111 |
| 6,640,070 | B1 * | 10/2003 | Sanmonji | 399/350 X |
| 6,714,752 | B1 | 3/2004 | Ueno et al. | 399/117 |
| 6,829,455 | B1 | 12/2004 | Yasumoto et al. | 399/167 |
| 2002/0025181 | A1 * | 2/2002 | Meguro | 399/350 X |
| 2002/0085854 | A1 | 7/2002 | Numagami et al. | 399/90 |
| 2004/0126131 | A1 | 7/2004 | Numagami et al. | 399/109 |

FOREIGN PATENT DOCUMENTS

| | | |
|---|---|---|
| JP | 06-202447 | 7/1994 |
| JP | 07-020692 | 1/1995 |
| JP | 7-175393 | 7/1995 |
| JP | 07-306621 | 11/1995 |
| JP | 11-311932 | 11/1999 |
| JP | 2002-132107 | 5/2002 |

* cited by examiner

CLEANING DEVICE, PROCESS CARTRIDGE, CLEANING MEMBER AND ELECTROPHOTOGRAPHIC IMAGE FORMING APPARATUS

BACKGROUND OF THE INVENTION

1. Field of the Invention

The present invention relates to a cleaning device for use in an electrophotographic image forming apparatus, a process cartridge which is detachably mountable to a main body of the electrophotographic image forming apparatus, a cleaning member for use in the process cartridge, and the electrophotographic image forming apparatus.

Here, an electrophotographic image forming apparatus is an image forming apparatus for forming an image on a recording medium (such as a paper or an OHP sheet) through an electrophotographic image forming process. As for examples of the electrophotographic image forming apparatus, for example, there are known an electrophotographic copying machine, an electrophotographic printer (such as a laser printer or an LED printer), facsimile equipment, a word processor, and a complex machine thereof (such as a multi-function printer).

2. Related Background Art

Heretofore, in the electrophotographic image forming apparatus as described above, an electrophotographic photosensitive member which is uniformly charged with electricity by charging means is subjected to selective exposure to thereby form an electrostatic latent image on the surface of the electrophotographic photosensitive member. Then, the electrostatic latent image is developed by developing means to obtain a visible image (developer image). Thereafter, the developer image is transferred to a recording paper (recording medium). Thus, an image is formed on the recording paper.

A developer remaining on the surface of the electrophotographic photosensitive member after the developer image is transferred to the recording paper is removed by cleaning means. Then, the operation proceeds to the next image formation.

Note that the developer which has been removed from the surface of the electrophotographic photosensitive member by the cleaning means is contained in a removed developer containing portion.

Now, in order that a cleaning blade used as the cleaning means may exhibit a sufficient cleaning effect, an edge portion of an elastic blade member must abut against the surface of the electrophotographic photosensitive member with high positional precision. When an inroad amount and an abutting angle of the edge portion of the elastic blade member with respect to the electrophotographic photosensitive member are not appropriate, there is a possibility that the developer remaining on the surface of the electrophotographic photosensitive member can not be sufficiently scraped off.

As a cause of such phenomena, it is conceivable that a sheet metal supporting the elastic blade member is deformed due to a deviation in the attachment position of the cleaning blade, and the sheet metal supporting the elastic blade member has insufficient strength.

As means for solving the problem of the insufficient strength of the sheet metal, thickening of the sheet metal has been conventionally adopted. However, this method is disadvantageous from the viewpoints of cost and lightening of the image forming apparatus. In addition, as another means, bending of the sheet metal is also performed in order to increase the strength of the sheet metal (refer to JP H07-175393 A and JP H06-95502 A).

In addition, in recent years, a demand for color electrophotographic image forming apparatuses, which can form a color image on a recording medium, has increased. Of those color electrophotographic image forming apparatuses, for example, a color electrophotographic image forming apparatus of a tandem system, in which drum-shaped electrophotographic photosensitive members, i.e., photosensitive drums, are disposed in a line in order to form developer images of yellow (Y), magenta (M), cyan (C) and black (B), has been put into practical use.

In particular, in a color electrophotographic image forming apparatus of a vertical tandem system in which a plurality of photosensitive drums are disposed in parallel in the vertical direction, in order to reduce a height of the electrophotographic image forming apparatus, the height of the removed developer containing portion must also be reduced.

As described above, compactness as well as high speed and high image quality are required for recent image forming apparatuses.

In order to meet this requirement, miniaturization is required for a main body of the image forming apparatus, and a process cartridge (cleaning device) occupying a large space within the image forming apparatus.

From this viewpoint, there is required miniaturization of components or parts constituting the process cartridge (cleaning device) and efficient placement of these components or parts.

SUMMARY OF THE INVENTION

In the light of the foregoing, it is an object of the present invention to provide a cleaning device for containing a larger volume of developer in a removed developer containing portion than in the conventional art, even if a height of the developer containing portion is unchanged, a process cartridge, a cleaning member, and an electrophotographic image forming apparatus to which the cleaning device, the process cartridge, and the cleaning member can be attached.

It is another object of the present invention to provide a cleaning device which is capable of reducing the height of a removed developer containing portion as compared with a developer containing portion having the same containing volume, a process cartridge, a cleaning member, and an electrophotographic image forming apparatus to which the cleaning device, the process cartridge and the cleaning member can be attached.

It is still another object of the present invention to provide a reduced height cleaning device and process cartridge to achieve miniaturization by reducing the height of a removed developer containing portion, and an electrophotographic image forming apparatus to which the cleaning device and the process cartridge can be attached.

It is yet another object of the present invention to provide a cleaning device in which a supporting member is bent at a plurality of locations to increase the strength of the supporting member, a process cartridge, a cleaning member, and an electrophotographic image forming apparatus to which the cleaning device, the process cartridge, and the cleaning member can be attached.

It is a further still another object of the present invention to provide a cleaning device in which a containing portion for containing a removed developer therein is constituted by an extension portion on a side opposite to an attachment surface of a supporting member where the supporting member is attached to a frame, a process cartridge, a cleaning member, and an electrophotographic image forming apparatus.

It is further yet another object of the present invention to provide a cleaning member, a cleaning device including the cleaning member, and an electrophotographic image forming apparatus using a process cartridge, the cleaning member including: an elastic blade adapted to elastically contact a photosensitive drum to remove a developer remaining on the photosensitive drum from the photosensitive drum; and a supporting member for supporting the elastic blade, the supporting member including a supporting portion to which the elastic blade is attached for supporting the elastic blade, the supporting portion being attached to the process cartridge; a first bent portion which is bent from the supporting portion to an opposite side opposite to an attachment surface where the supporting portion is attached to a frame, in an orthogonal direction orthogonal to the supporting portion; a connecting portion which extends from the first bent portion to the opposite side in the orthogonal direction; a second bent portion which is bent from the connecting portion to a side opposite to a side where the elastic blade is provided, in the orthogonal direction and in a lateral direction of the supporting portion; and an extension portion which extends from the second bent portion to the side opposite to the side where the elastic blade is provided, in the orthogonal direction and in the lateral direction, wherein when the cleaning member is attached to the process cartridge, the cleaning member constitutes a part of a removed developer containing portion for containing therein the developer removed from the electrophotographic photosensitive drum by the elastic blade.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Preferred embodiments of a cleaning member, a cleaning device, a process cartridge and an electrophotographic image forming apparatus will hereinafter be described with reference to the accompanying drawings.

First Embodiment

Figure 1:
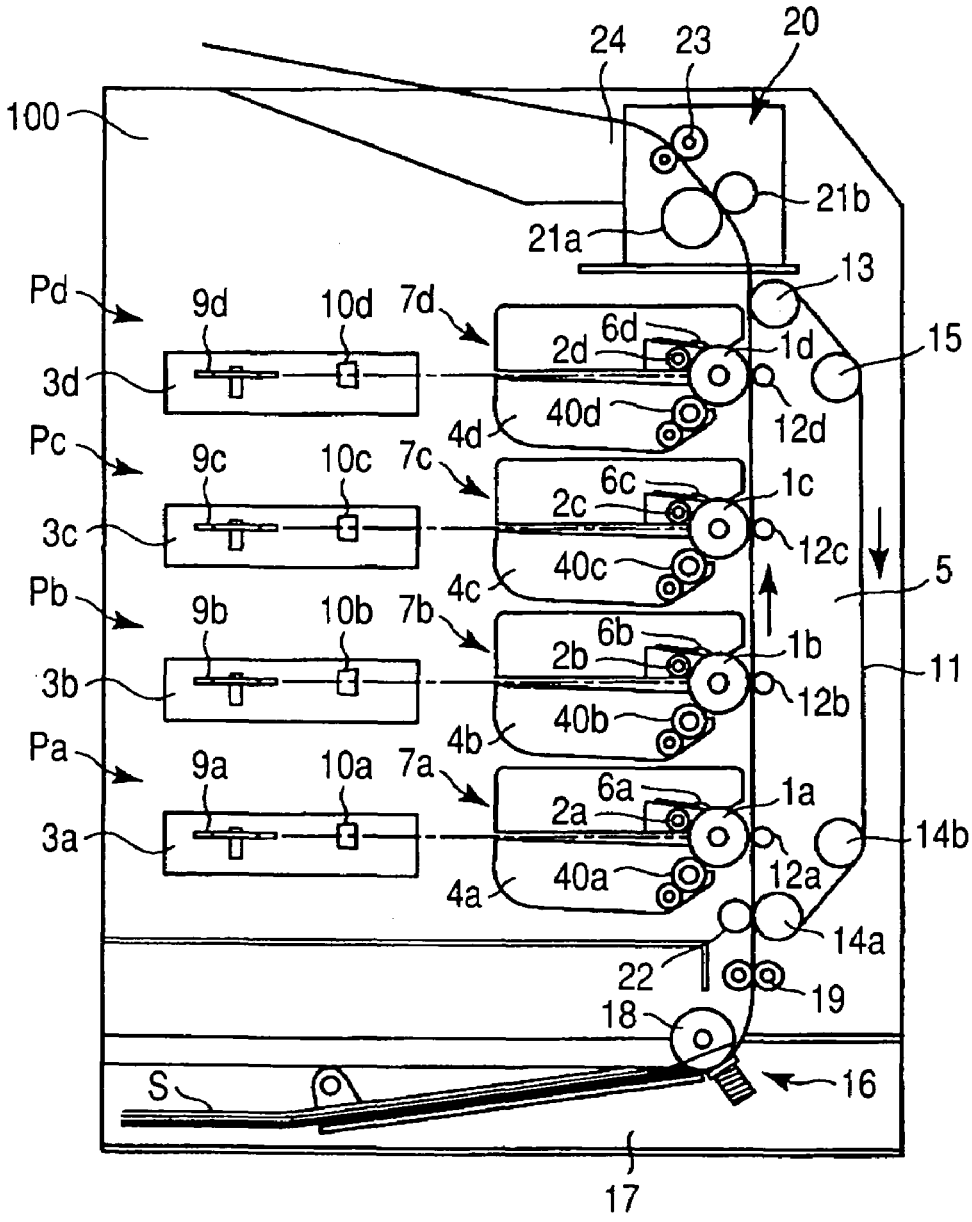
FIG. 1 is a schematic view showing an overall construction of an embodiment of an image forming apparatus to which the present invention is applied.

FIG. 1 shows an overall construction of a color electrophotographic image forming apparatus as an embodiment of the electrophotographic image forming apparatus according to the present invention. First of all, the overall construction of the color electrophotographic image forming apparatus will now be described with reference to FIG. 1.

(Overall Construction of Image Forming Apparatus)

Referring to FIG. 1, in the color electrophotographic image forming apparatus, a plurality of image forming stations, i.e., four image forming stations Pa, Pb, Pc and Pd in this embodiment are longitudinally disposed in parallel with one another in a main body 100 of the image forming apparatus. Process cartridges 7 (7*a*, 7*b*, 7*c* and 7*d*) are detachably mounted to the image forming stations Pa, Pb, Pc and Pd by mounting means (not shown), respectively.

While in this embodiment, the image forming stations Pa, Pb, Pc and Pd are longitudinally, i.e., nearly vertically disposed in parallel with one another in a line, the disposition direction of the image forming stations Pa, Pb, Pc and Pd may be slightly inclined with respect to the vertical direction.

The cartridges 7 (7*a*, 7*b*, 7*c* and 7*d*) include drum shaped electrophotographic photosensitive members (hereinafter referred to as hotosensitive drums for short) 1 (1*a*, 1*b*, 1*c* and 1*d*), respectively. The photosensitive drums 1 (1*a*, 1*b*, 1*c* and 1*d*) are adapted to be driven to be rotated in a counterclockwise direction in FIG. 1 by driving means (not shown). Charging means 2 (2*a*, 2*b*, 2*c* and 2*d*) for uniformly charging surfaces of the photosensitive drums 1 (1*a*, 1*b*, 1*c* and 1*d*) with electricity, respectively; scanner units (3*a*, 3*b*, 3*c* and 3*d*) for applying laser beams to surfaces of the photosensitive drums 1 (1*a*, 1*b*, 1*c* and 1*d*) based on image information to form electrostatic latent images on the surfaces of the photosensitive drums 1 (1*a*, 1*b*, 1*c* and 1*d*), respectively; developing means 4 (4*a*, 4*b*, 4*c* and 4*d*) for sticking developers to the electrostatic latent images to develop the electrostatic latent images as developer images, respectively; an electrostatic transfer device 5 for transferring the developer images on the surfaces of the photosensitive drums 1 (1*a*, 1*b*, 1*c* and 1*d*) onto a recording medium; and cleaning devices 6 (6*a*, 6*b*, 6*c* and 6*d*) for removing residual developers remaining on the surfaces of the photosensitive drums 1 (1*a*, 1*b*, 1*c* and 1*d*) after completion of the transferring process are disposed in order along a rotational direction of the photosensitive drums 1 (1*a*, 1*b*, 1*c* and 1*d*) in the peripheries of the photosensitive drums 1 (1*a*, 1*b*, 1*c* and 1*d*).

In this embodiment, the photosensitive drums 1 (1*a*, 1*b*, 1*c* and 1*d*), the charging means 2 (2*a*, 2*b*, 2*c* and 2*d*), the developing means 4 (4*a*, 4*b*, 4*c* and 4*d*), and the cleaning devices 6 (6*a*, 6*b*, 6*c* and 6*d*) are integrated with one another to constitute the process cartridges 7 (7*a*, 7*b*, 7*c* and 7*d*), respectively.

A description will hereinafter be given in due order from the photosensitive drums 1 (1*a*, 1*b*, 1*c* and 1*d*) with reference to FIG. 2 as well.

Each of the photosensitive drums 1 (1*a*, 1*b*, 1*c* and 1*d*) is formed by providing a photoconductive layer on an outer peripheral surface of a cylinder made of aluminum. Both end portions of each of the photosensitive drums 1 (1*a*, 1*b*, 1*c* and 1*d*) are rotatably supported by supporting members, respectively, and a driving force is transmitted from a driving motor (not shown) to one end portion thereof. As a result, each of the photosensitive drums 1 (1*a*, 1*b*, 1*c* and 1*d*) is driven to be rotated in a counterclockwise direction.

The charging means 2 (2*a*, 2*b*, 2*c* and 2*d*) are electrically conductive rollers. The charging rollers 2 (2*a*, 2*b*, 2*c* and 2*d*) are made to abut against the surfaces of the photosensitive drums 1 (1*a*, 1*b*, 1*c* and 1*d*), respectively. Charging bias voltages are applied to the charging rollers 2 (2*a*, 2*b*, 2*c* and 2*d*) to uniformly charge the surfaces of the photosensitive drums 1 (1*a*, 1*b*, 1*c* and 1*d*).

The scanner units (3*a*, 3*b*, 3*c* and 3*d*) apply image light beams corresponding to image signals from laser diodes (not shown) to the surfaces of the photosensitive drums 1 (1*a*, 1*b*, 1*c* and 1*d*) which are already charged through polygon mirrors (9*a*, 9*b*, 9*c* and 9*d*) rotating at a high speed and imaging lenses (10*a*, 10*b*, 10*c* and 10*d*) to selectively expose the surfaces of the photosensitive drums 1 (1*a*, 1*b*, 1*c* and 1*d*), thereby forming electrostatic latent images on the surfaces of the photosensitive drums 1 (1*a*, 1*b*, 1*c* and 1*d*), respectively.

The developing means 4 (4*a*, 4*b*, 4*c* and 4*d*) have developer containers 41, which are adapted to contain therein developers of yellow, magenta, cyan and black, respectively. The developer contained in the developer container 41 is sent to a developer supplying roller 43 by a feeding mechanism 42.

Figure 2:
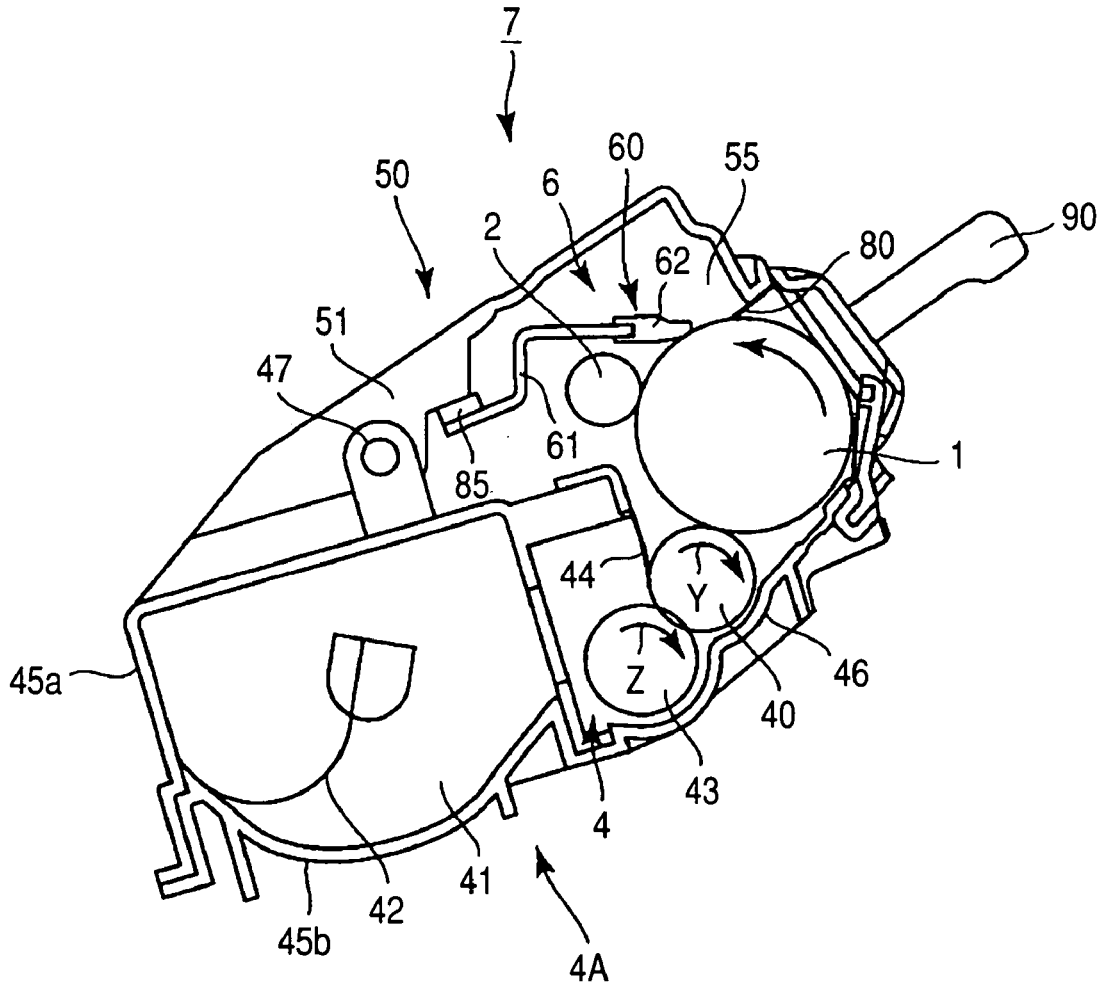
FIG. 2 is a cross-sectional view of a process cartridge which is detachably mounted to the image forming apparatus to which the present invention is applied.

The developer supplying roller 43 rotates in a clockwise direction in FIG. 2. The developer supplying roller 43 supplies the developer to the developing roller 40 and also scrapes off the residual developer from the developing roller 40.

The developer which has been supplied to the developing roller 40 is applied to an outer periphery of the developing roller 40 (rotating clockwise in FIG. 2) by a developing blade 44 which is pressed against the outer periphery of the developing roller 40. Also, the developer is given the electric charges. Then, a developing bias is applied to the developing roller 40 closely facing the surface of the photosensitive drum 1 having the electrostatic latent image formed thereon. As a result, the developing roller 40 develops the electrostatic latent image formed on the surface of the photosensitive drum 1.

The transfer device 5 has an electrostatically charged transfer belt 11 which is disposed so as to face all the photosensitive drums 1 (1*a*, 1*b*, 1*c* and 1*d*) and which is adapted to move in circles while contacting the surfaces of all the photosensitive drums 1 (1*a*, 1*b*, 1*c* and 1*d*).

The transfer belt 11 is stretched around a driving roller 13, driven rollers 14*a* and 14*b*, and a tension roller 15. Then, the transfer belt 11 moves in circles so as to electrostatically attract a recording medium S to cause the recording medium S to contact the surface of the photosensitive drum 1. As a result, the recording medium S is conveyed up to a transfer position by the transfer belt 11 and the developer image on the surface of the photosensitive drum 1 is transferred onto the recording medium S.

Transfer rollers (12*a*, 12*b*, 12*c* and 12*d*) are provided in parallel with one another in positions which face the four photosensitive drums 1 (1*a*, 1*b*, 1*c* and 1*d*), respectively, so as to abut against the inner side of the transfer belt 11. A bias voltage having a positive polarity is applied to each of the transfer rollers (12*a*, 12*b*, 12*c* and 12*d*) during the transfer process. Then, the developer image is transferred onto the recording medium S contacting the surface of the photosensitive drum 1.

Conveying means 16 conveys the recording medium S to the image forming station to discharge the recording medium S. Here, a plurality of sheets of recording media S are contained in a cassette 17. During image formation, a pair of sheet feeding rollers (semicircular rollers) 18, and a pair of registration rollers 19 are driven to be rotated in correspondence to an image forming operation. As a result, the recording media S contained in the cassette 17 are separately fed one at a time. A leading edge of the recording medium S hits a pair of registration rollers 19 to be temporarily stopped. Thereafter, the recording medium S is conveyed to the transfer belt 11 based on synchronization between the rotation of the transfer belt 11 and an image writing position by the pair of registration rollers 19. Note that the conveying means 16 includes the pair of sheet feeding rollers (semicircular rollers) 18, the pair of registration rollers 19, the transfer belt 11, and a pair of sheet discharging rollers 23, which will be described later.

A fixing portion 20 serves to fix the developer image having a plurality of colors transferred onto the recording medium S to the recording medium S. The fixing portion 20 includes a heating roller 21*a*, which rotates, and a pressing roller 21*b*, which is pressed against the heating roller 21*a* to provide the recording medium S with heat and the pressure.

During the image forming operation, the photosensitive drums 1 (1*a*, 1*b*, 1*c* and 1*d*) are driven to be rotated in a counterclockwise direction at an image formation timing. Then, the scanner units (3*a*, 3*b*, 3*c* and 3*d*) corresponding to each of the cartridges 7 (7*a*, 7*b*, 7*c* and 7*d*) are successively driven. The charging rollers 2 (2*a*, 2*b*, 2*c* and 2*d*) give the uniform electric charges to the peripheral surfaces of the photosensitive drums 1 (1*a*, 1*b*, 1*c* and 1*d*) through this driving operation, respectively. Then, the scanner units (3*a*, 3*b*, 3*c* and 3*d*) expose the peripheral surfaces of the photosensitive drums 1 (1*a*, 1*b* 1*c* and 1*d*) in correspondence to an image signal to form the electrostatic latent images on the peripheral surfaces of the photosensitive drums 1 (1*a*, 1*b* 1*c* and 1*d*), respectively. The developing rollers 40(40*a*, 40*b*, 40*c* and 40*d*) transfer the developers to low electric potential portions of the electrostatic latent images to form (develop) the developer images on the peripheral surfaces of the photosensitive drums 1 (1*a*, 1*b* 1*c* and 1*d*), respectively.

The pair of registration rollers 19 start to rotate so that at a timing when a leading end of the developer image formed on the peripheral surface of the most upstream photosensitive drum 1*a* is conveyed to a facing point with the transfer belt 11 through the rotation, a print starting position of the recording medium S agrees with this facing point. Then, the pair of registration rollers 19 convey the recording medium S to the transfer belt 11.

The recording medium S is then pressed against an outer periphery of the transfer belt 11 so as to be held between the electrostatically attracting roller 22 and the transfer belt 11. As a result, the recording medium S is stably attracted on the transfer belt 11 to be conveyed up to the most downstream transferring portion.

The developer images on the surfaces of the photosensitive drums 1 (1*a*, 1*b*, 1*c* and 1*d*) are successively transferred onto the recording medium S by electric fields generated between the photosensitive drums 1 (1*a*, 1*b*, 1*c* and 1*d*) and the transfer rollers (12*a*, 12*b*, 12*c* and 12*d*), respectively, while the recording medium S is conveyed in such a manner.

The recording medium S onto which the developer images of the four colors have been transferred is separated from the transfer belt 11 with assistance of a curvature of the belt driving roller 13 to be carried to the fixing portion 20. After the developer images of the four colors are thermally fixed onto the recording medium S in the fixing portion 20, the recording medium S is discharged from a discharging portion 24 to the outside by the pair of discharging rollers 23.

(Construction of Process Cartridge)

Next, the process cartridge according to the present invention will be described with reference to FIGS. 2, 3A and 3B.

Figure 3A:
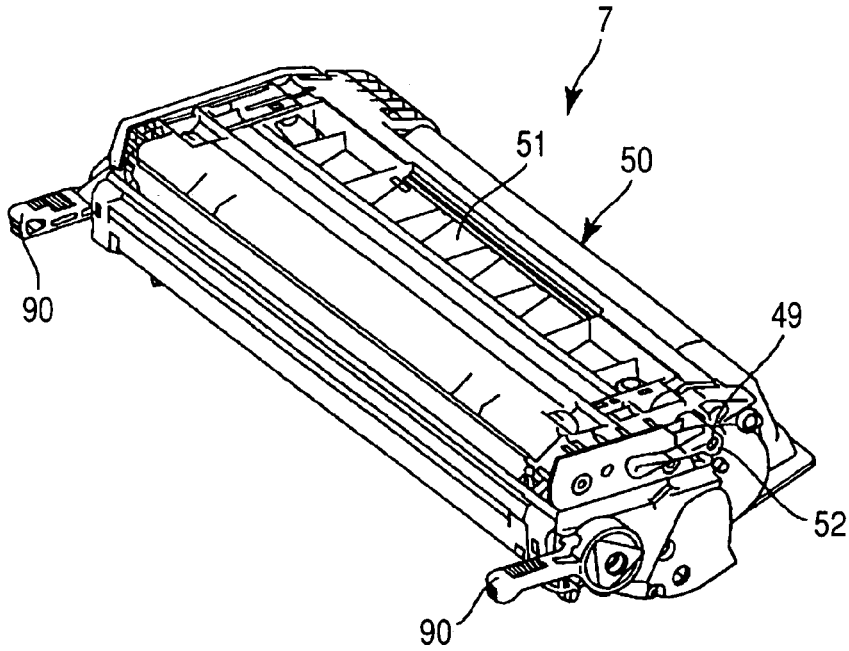
FIGS. 3A and 3B are perspective views each showing the process cartridge to which the present invention is applied.
Figure 3B:
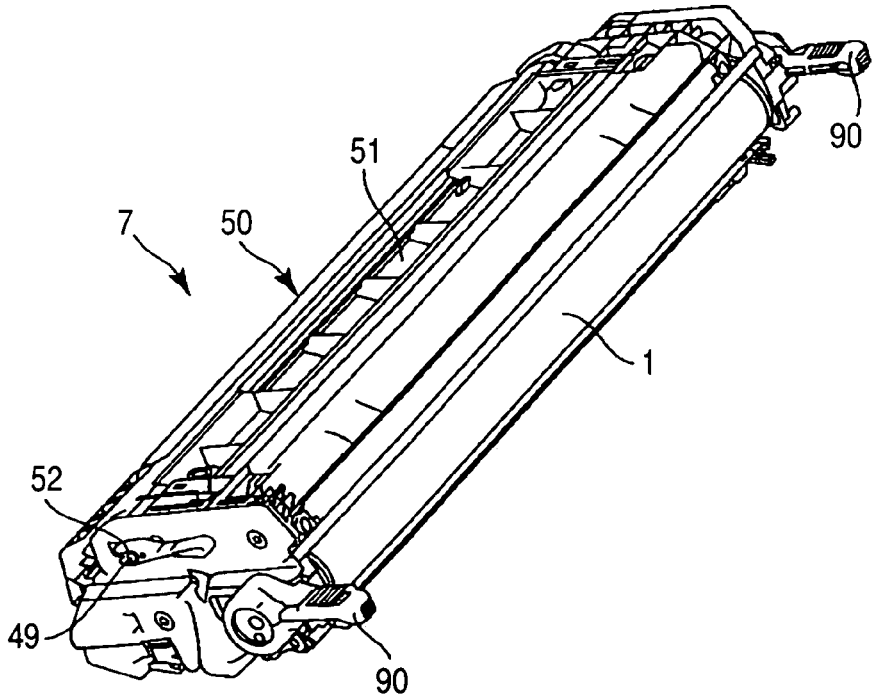

FIG. 2 and FIGS. 3A and 3B are a main cross-sectional view and perspective views of the process cartridge 7 adapted to contain therein the developer. Note that the process cartridges 7 (7*a*, 7*b*, 7*c* and 7*d*) of yellow, magenta, cyan and black have the same construction.

The process cartridge 7 separately includes the photosensitive drum 1, a cleaner unit 50 having the charging means 2 and the cleaning device 6, and a developing unit 4A having developing means 4 for developing the electrostatic latent image on the photosensitive drum 1.

The photosensitive drum 1 is rotatably held in a cleaning frame 51 constituting the cleaner unit 50 through a bearing member (not shown).

The charging means 2, a cleaning blade 60 of the cleaning device 6 for scraping the developer (residual developer) remaining on the surface of the photosensitive drum 1 after completion of the transfer process, and a flexible sheet member 80 are disposed around the peripheral surface of the photosensitive drum 1. Moreover, the residual developer (removed developer) removed from the surface of the photosensitive drum 1 is contained in a removed developer containing chamber 55 serving as a removed developer containing portion provided in the cleaning frame 51.

In addition, the developer remaining on the surface of the photosensitive drum 1 after completion of the transfer passes through an abutting portion between the flexible sheet member 80 and the photosensitive drum 1 to reach a position of the cleaning blade 60. The flexible sheet member 80 softly contacts the surface of the photosensitive drum 1 so that the removed developer can pass through the abutting portion between the flexible sheet member 80 and the photosensitive drum 1. Thus, the removed developer is prevented from leaking to the outside of the cleaning frame 51.

The developing unit 4A has developing frames (45*a* and 45*b*) for containing therein the developer. The developing frames 45*a* and 45*b* are joined to each other (by utilizing an ultrasonic fusion-bonding method or the like) to constitute a developing container unit 46. The developing roller 40 adapted to rotate (in a direction indicated by an arrow Y) while leaving a minute gap between the photosensitive drum 1 and itself is rotatably supported in the developing container unit 46 through a bearing member (not shown). In addition, the developing roller 40, the developer supplying roller 43, and the developing blade 44 are disposed in the developing container unit 46. Moreover, a developer carrying mechanism 42 is provided within the developing container unit 46.

Connecting holes 47 provided in the both ends of the developing container unit 46 are aligned with supporting holes 52 provided in the both ends of the cleaning frame 51, and in this state, pins 49 are inserted from the both ends of the cleaning frame 51 into the connecting holes 47 and the supporting holes 52, whereby the overall developing unit 4A is swingably supported with respect to the cleaner unit 50.

In addition, the developing unit 4A is constantly urged by a compression spring (not shown) so that the developing roller 40 contacts the surface of the photosensitive drum 1.

(Method of Mounting/Detaching Process Cartridge to/from Main Body of Image Forming Apparatus)

Next, a method of mounting/detaching the process cartridge 7 to/from the main body 100 of the image forming apparatus will be described with reference to FIG. 4.

Figure 4:
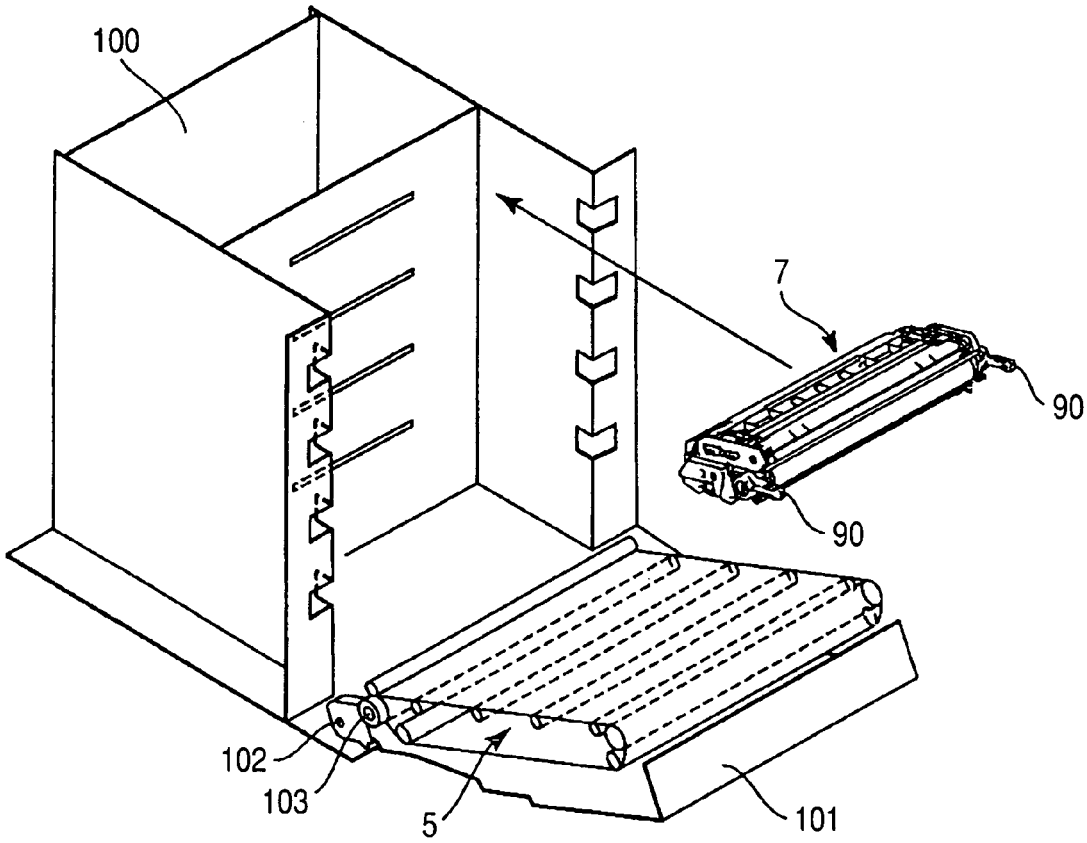
FIG. 4 is a perspective view showing a state in which the process cartridge is mounted on a main body of the image forming apparatus to which the present invention is applied.

As shown in FIG. 4, an opening/closing door (front door) 101 is swingably provided in the main body 100 of the image forming apparatus with a supporting axis 102 as a center. The transfer device 5 is attached to an inner portion of the front door 101 using link means (not shown). The transfer device 5 can swing around the supporting axis 103 along with the swinging operation of the front door 101. In a state in which the front door 101 and the transfer device 5 are open, the cartridge 7 can be mounted/detached to/from the main body 100 of the image forming apparatus. Handle members 90 are provided in both ends of the process cartridge 7 in a longitudinal direction, respectively. When mounting/detaching the process cartridge 7 to/from the main body 100 of the image forming apparatus, an operator holds the handle members 90.

An insertion guide portion (not shown) which is provided in the process cartridge 7 is engaged with a guide rail portion (not shown) which is provided for each image forming station within the main body 100 of the image forming apparatus, whereby the process cartridge 7 is mounted in a predetermined position to be detachably mounted to the main body 100 of the image forming apparatus.

(Construction of Cleaning Blade)

Next, a description will be given with respect to the construction of the cleaning blade of the cleaning device to which an embodiment of the present invention is applied. A description will hereinafter be given with respect to the construction of the cleaning blade 60 provided in the process cartridge 7 with reference to FIGS. 2, and 5 to 7.

Figure 6:
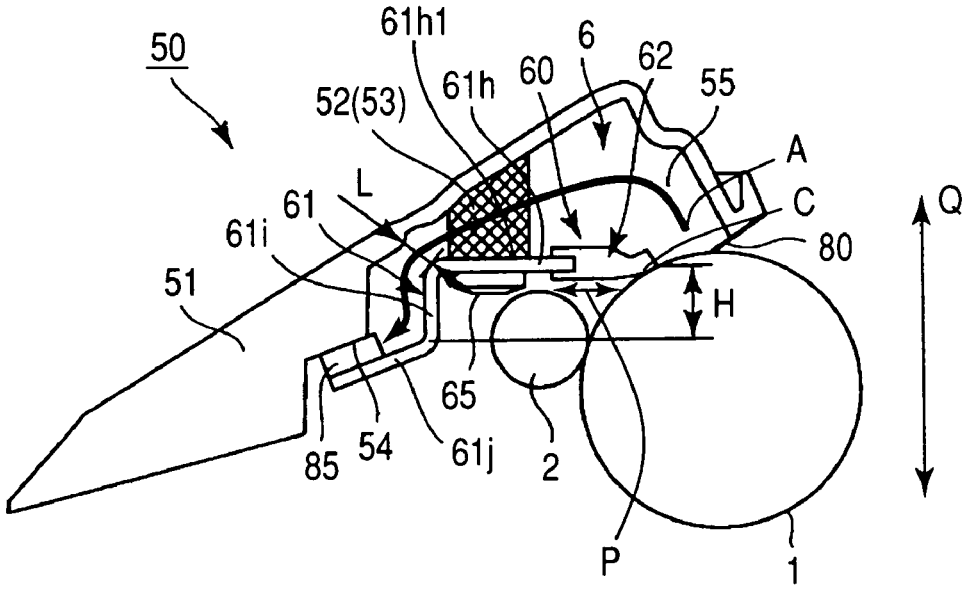
FIG. 6 is a cross-sectional view of an embodiment of a cleaning device to which the present invention is applied.
Figure 7:
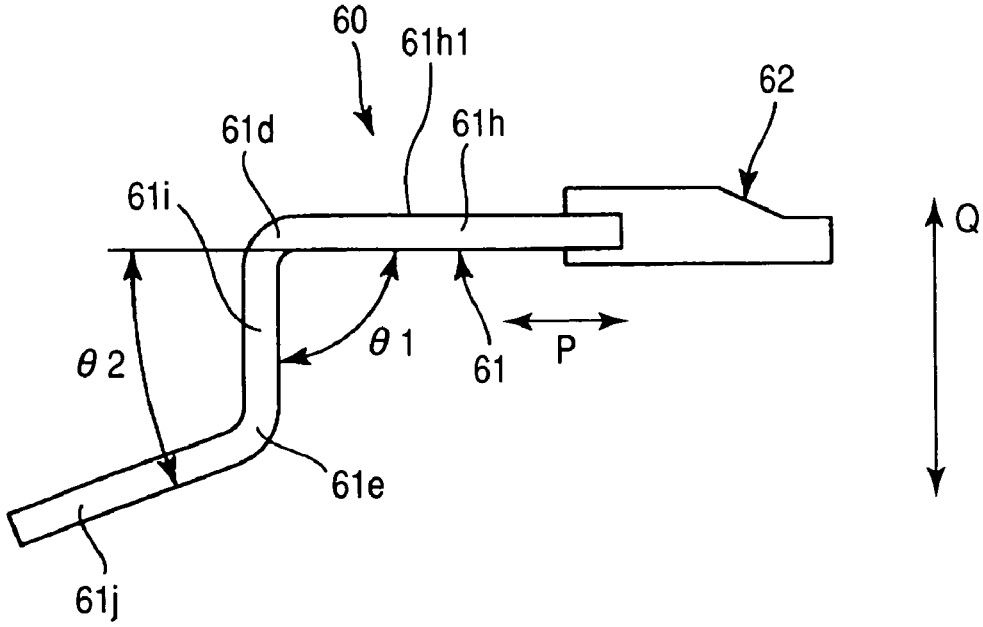
FIG. 7 is a side elevational view showing the shape of a cleaning blade shown in FIG. 6.

As shown in FIG. 7, the cleaning blade 60 serving as a cleaning member has an elastic blade 62 which is made of a rubber member and which is adapted to abut the surface of the photosensitive drum 1, and a supporting sheet metal 61 serving as a member for supporting the elastic blade member 62. The elastic blade 62 is fixed to the supporting sheet metal 61 through bonding or integral forming. The elastic blade 62 serves to remove the developer remaining on the surface of the photosensitive drum 1 from the surface of the photosensitive drum 1. Note that in FIGS. 2, 6 and 10A, symbol C designates a cleaning operation position. The cleaning operation position C is a position where the cleaning blade 62 comes into contact with the surface of the photosensitive drum 1 to remove the developer remaining on the surface of the photosensitive drum 1 from the surface of the photosensitive drum 1.

The supporting sheet metal 61 is formed of a steel plate with a thickness of 1.0 to 1.6 mm (e.g., a sheet metal made of iron). The supporting sheet metal 61 has at least two bent portions, i.e., a first bent portion 61*d* and a second bent portion 61*e*. In addition, the supporting sheet metal 61 has three flat portions which are connected through the two bent portions 61*d* and 61*e*. That is to say, the supporting sheet metal 61 has a supporting portion 61*h* which is attached to the cleaning frame 51 serving as a frame and which serves to support the elastic blade 62. In addition, the supporting sheet metal 61 also has a connecting portion 61*i* located between the first and second bent portions 61*d* and 61*e*, and an extension portion 61*j* extending from the second bent portion 61*e*. Moreover, the supporting portion 61*h* and the connecting portion 61*i* are connected to each other through the first bent portion 61*d*. Likewise, the connecting portion 61*i* and the extension portion 61*j* are connected to each other through the second bent portion 61*e*. In this embodiment, the supporting portion 61*h*, the connecting portion 61*i* and the extension portion 61*j* are all flat.

Figure 8:
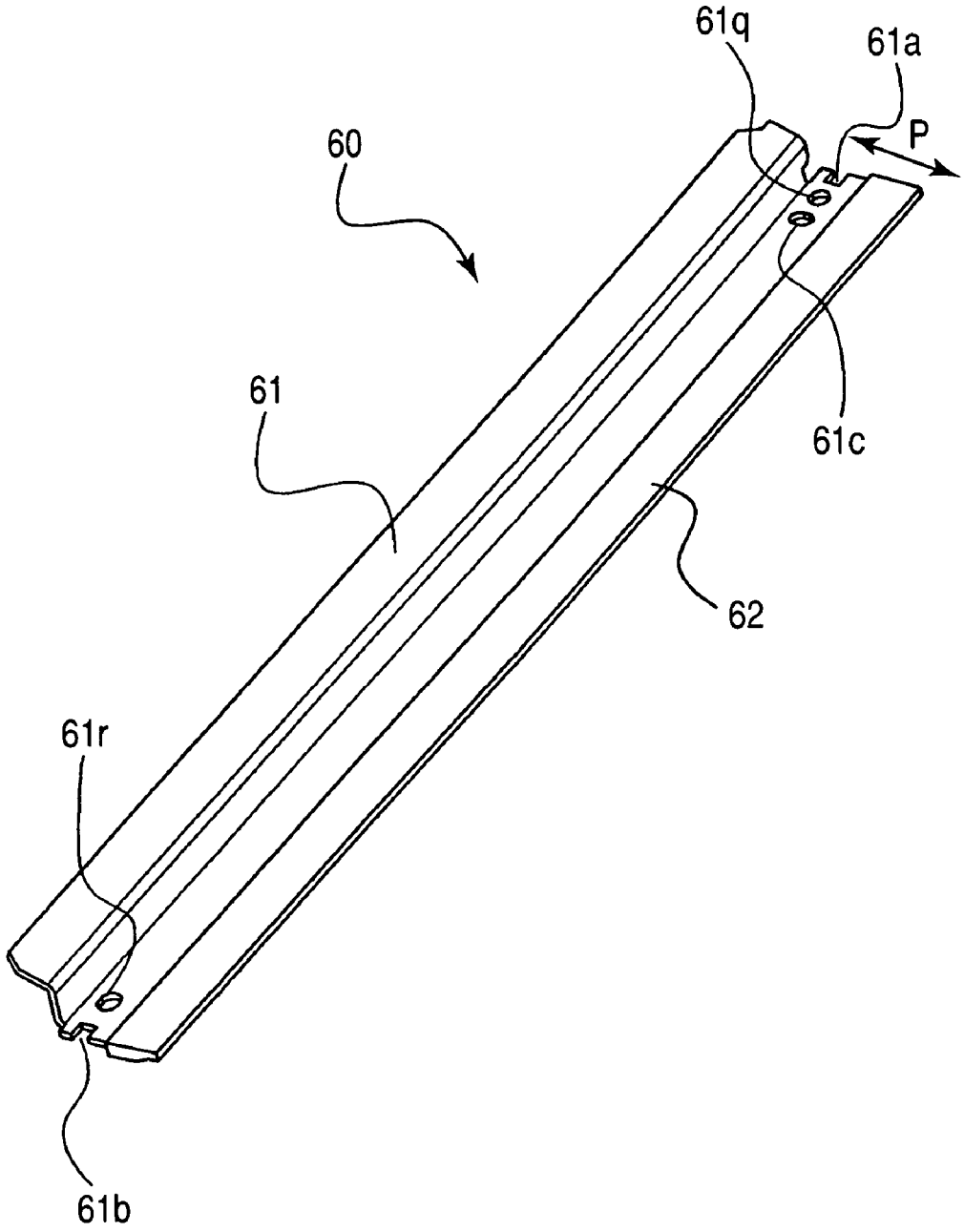
FIG. 8 is a perspective view showing the shape of the cleaning blade shown in FIG. 6.
Figure 10A:
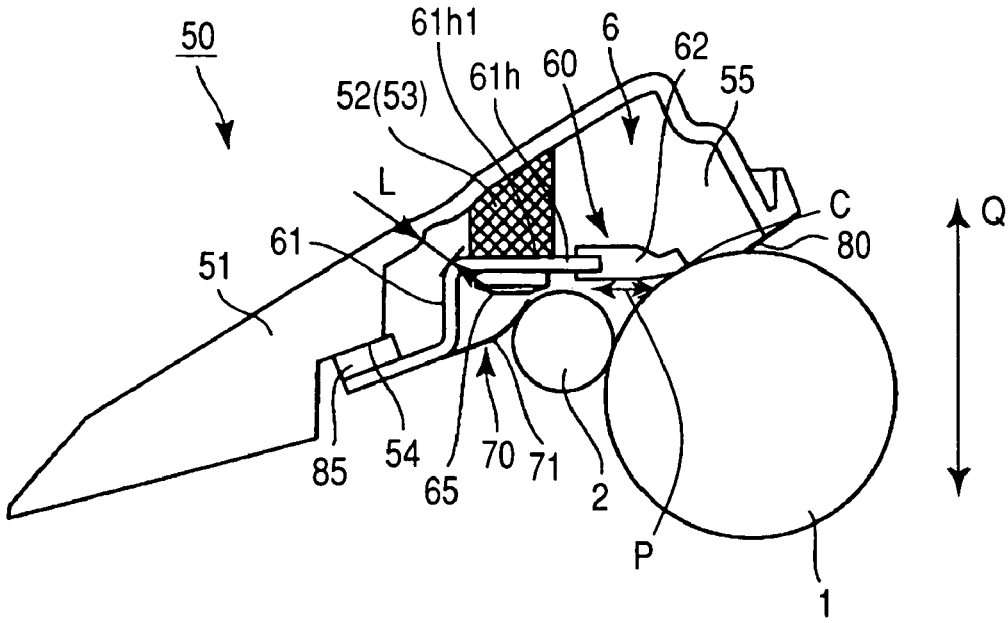
FIGS. 10A and 10B are cross-sectional views each showing another embodiment of a cleaning device to which the present invention is applied.

As shown in FIGS. 6 and 10A, according to this embodiment, the process cartridge 7 (the cleaning device 6) is attached to the main body 100 of the image forming apparatus such that the supporting portion 61*h* is nearly horizontally disposed (in this embodiment, the supporting portion 61*h* is upwardly inclined by about 2° with respect to the horizontal direction). Both the connecting portion 61*i* and the extension potion 61*j* extend downward. In addition, the extension portion 61*j* is disposed at a position vertically lower than the cleaning operation position C where the elastic blade 62 contacts the surface of the photosensitive drum 1. That is to say, the first bent portion 61*d* is bent downward. The connecting portion 61*i* extends downward from the first bent portion 61*d*. The extension portion 61*j* extends downward from the second bent portion 61*e* and also extends to the side opposite to the side where the elastic blade 62 is provided in a lateral direction P (refer to FIGS. 7 and 8) of the supporting portion 61*h*. The supporting portion 61*h* is disposed so as to bestride over the charging roller 2. The connecting portion 61*i* is disposed in the side end of the charging roller 2. Thus, the supporting member 61 extends to the back of the removed developer containing chamber 55 so as to avoid the charging roller 2. The supporting member 61 and the elastic blade 62 constitute a bottom surface of the removed developer containing chamber 55. Hence, the extension portion 61*j* constitutes the removed developer containing chamber 55 by utilizing effectively the dead space on an inner portion side, in which the charging roller 2 is installed. The residual developer which has been removed in the cleaning operation position C from the surface of the photosensitive drum 1 is gradually pushed to move backward. At this time, the backward movement of the removed developer is promoted by an air flow A as well. In this embodiment, the supporting member 61 (the extension portion 61*j*) constitutes a space for containing the removed developer. As a result, when the removed developer gradually moves on the supporting portion 61*h* to pass through the supporting portion 61*h*, the removed developer falls onto the extension portion 61*j* due to its own weight and the operation of the air flow A. Then, the removed developer is contained within the space defined by the cleaning frame 51, a filter 85, and the extension portion 61*j*. Consequently, according to this embodiment, the removed developer can be contained in an inner portion side farther away from the cleaning operation position C. In addition, the removed developer can be contained through the effective utilization of the space on the side of the charging roller 2.

In addition, in this embodiment, the supporting sheet metal 61 is formed of a steel plate with a thickness of 1.2 mm. The supporting sheet metal 61 is bent in a crank-like shape at each of the first and second bent portions 61*d* and 61*e*. The supporting portion 61*h*, the connecting portion 61*i* and the extension portion 61*j* are connected to each other through the first and second bent portions 61*d* and 61*e*.

An angle θ1 of the first bent portion 61*d*, i.e., a folding angle of the connecting portion 61*i* with respect to the supporting portion 61*h* is in a range of 90° to 100°, and is about 90° in this embodiment. In addition, an angle θ2 of the second bent portion 61*e*, i.e., a folding angle of the extension portion 61*j* with respect to the supporting portion 61*h* is in a range of 0° to 30°, and is about 21° in this embodiment (refer to FIG. 7).

Note that while this embodiment has been described with respect to the specific case where the supporting portion 61*h* is nearly horizontally disposed, the present invention is not intended to be limited to this disposition. For example, the supporting portion 61*h* may be inclined upward with respect to the horizontal direction, or may be inclined downward with respect to the horizontal direction. In such cases, the same effects as those described above can be obtained.

Consequently, the supporting member 61 has the first bent portion 61*d*, which is bent from the supporting portion 61*h* to the side opposite to an attachment surface 61*h*1 through which the supporting member 61 is attached to the cleaning frame 51 along a direction Q orthogonal to the extension direction of the supporting portion 61*h* (refer to FIGS. 6, 7 and 10A), the connecting portion 61*i*, which extends from the first bent portion 61*d* to the side opposite to the attachment surface 61*h*1 along the orthogonal direction Q, the second bent portion 61*e*, which is bent downward from the connecting portion 61*i* to a side opposite to the side where the elastic blade 62 is provided in a lateral direction P (refer to FIGS. 7 and 8) of the supporting portion 61*h* and along the orthogonal direction Q, and the extension portion 61*j*, which extends from the second bent portion 61*e* to the side opposite to the side where the elastic blade 62 is provided in the lateral direction P of the supporting portion 61*h* and along the orthogonal direction Q.

The angle θ1 is set in the above-mentioned range, whereby it is possible to ensure the sufficient strength and the processing precision of the supporting sheet metal 61. Also, it is possible to ensure a volume of the removed developer containing chamber 55. In addition, the angle θ2 is set in the above-mentioned range, whereby it is possible to ensure the sufficient strength of the supporting sheet metal 61, and also the sufficient rubbing performance can be ensured for the peripheral surface of the charging roller 2.

As shown in FIG. 6, the above-mentioned fixing of the supporting sheet metal 61 to the cleaning frame 51 is carried out by fastening the supporting portion 61*h* to the cleaning frame 51 with screws 65. Note that the supporting portion 61*h* is attached to the cleaning frame 51 through its attachment surface 61*h*1.

A plurality of bent portions (61*d* and 61*e*) are provided in the supporting sheet metal 61. As a result, the supporting sheet metal 61 is formed into a crank-like shape, and thus the strength of the supporting sheet metal itself is larger than that of a normal supporting sheet metal having an L-like bent configuration in cross section. Moreover, the supporting portion 61*h* of the supporting sheet metal 61 is attached to the frame 51, whereby the position where the supporting sheet metal 61 is fastened to the frame 51 with the screws 65 can be made close to the elastic blade member 62. As a result, the strength of the cleaning blade 60 (cleaning member) increases.

Figure 5:
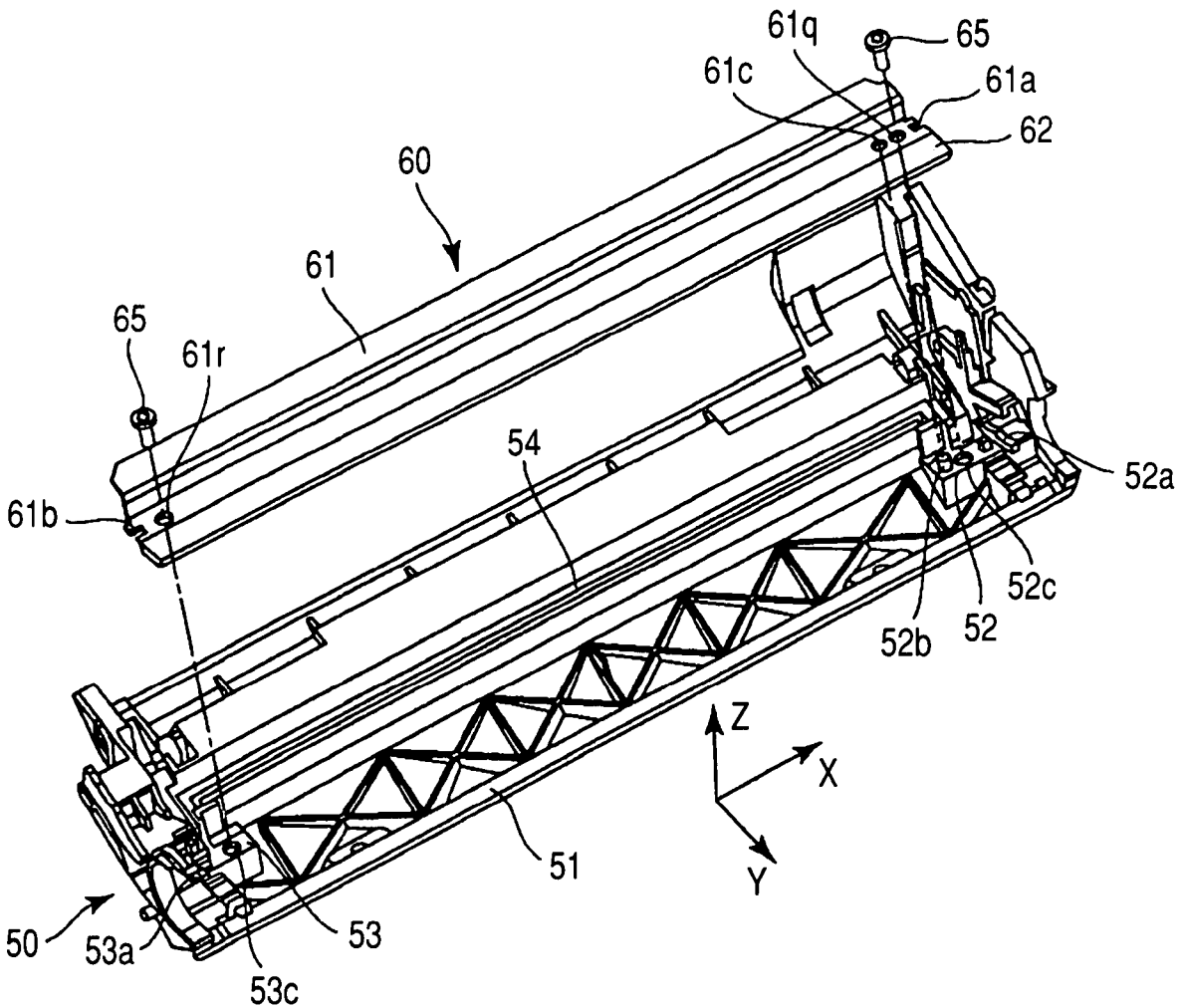
FIG. 5 is a perspective view for illustrating assembly of a cleaning member to which the present invention is applied to a cleaning frame.
Figure 9:
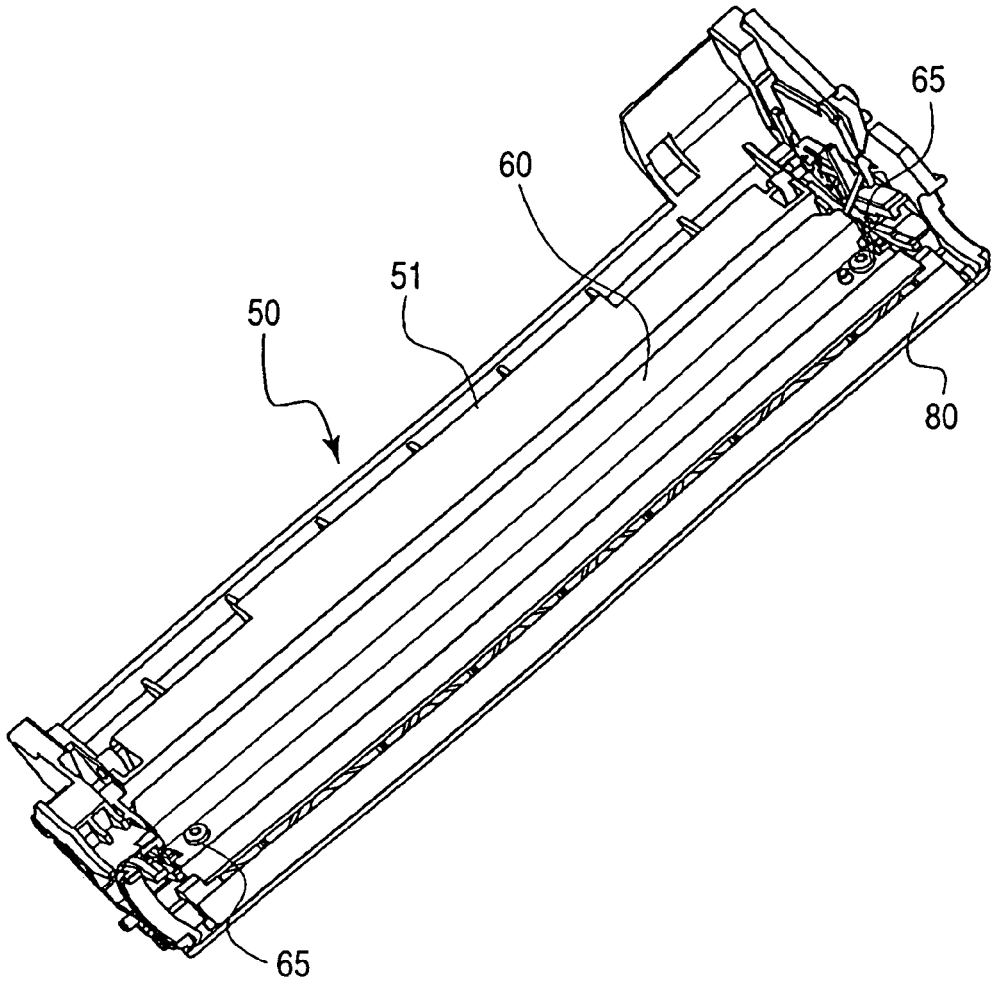
FIG. 9 is a perspective view showing a state in which the cleaning member to which the present invention is applied is attached to the cleaning frame.

As described above, the supporting sheet metal 61 is fastened to the cleaning frame 51 serving as the casing of the cleaner unit 50 with the screws 65 (tap tight screws) (refer to FIGS. 5 and 6). The supporting sheet metal 61 is fastened to bearing surfaces 52 and 53 on the both ends of the cleaning frame 51 with screws at the opposite ends thereof in a longitudinal direction. In this connection, the screws 65 extend completely through hole portions 61*q* and 61*r* bored through the supporting sheet metal 61 to be screwed into hole portions 52*c* and 53*c* provided in the bearing surfaces 52 and 53, respectively (refer to FIGS. 5, 8 and 9). In addition, the screw 65 is not especially limited in its head shape, and hence may adopt an arbitrary shape as the head shape.

In FIG. 5, the position of the cleaning blade 60 (the cleaning frame 51) in the longitudinal direction (in the direction of an X-axis) is determined by engaging a positioning boss 52*b* provided on the bearing surface 52 with a long round-hole 61*c* bored through the supporting sheet metal 61. Moreover, the position of the cleaning blade 60 (the cleaning frame 51) in the lateral direction (in the direction of a Y-axis) is determined by engaging square bosses 52*a* and 53*a* provided on the bearing surfaces 52 and 53 with cutout portions 61*a* and 61*b* provided in the supporting sheet metal 61, respectively. In addition, the position of the cleaning blade 60 (the cleaning frame 51) in the height direction (in the direction of a Z-axis) is determined by a height of each of the bearing surfaces 52 and 53. The cleaning blade 60 precisely abuts against the photosensitive drum 1 based on those factors.

In this embodiment, a force acting on the cleaning blade 60 is in a range of about 1.5 to 2.5 kg in the overall longitudinal direction of the cleaning blade 60 in a stationary state, i.e., in a state in which the cleaning blade 60 abuts against the photosensitive drum 1. While the photosensitive drum is rotated, since a frictional force generated between the elastic blade member 62 and the photosensitive drum 1 is added to the above-mentioned force, the resultant force falls within a range of about 2.0 to 4.0 kg.

A plurality of bent portions are provided in the supporting sheet metal 61, and the fixing position where the supporting sheet metal 61 is fixed to the cleaning frame 51 is made close to the elastic blade member 62 as in this embodiment, whereby the cleaning blade 60 is prevented from bending at its central portion in the longitudinal direction in a direction of moving away from the photosensitive drum 1.

In addition, the first bent portion 61*d* is made close to the elastic blade member 62 as much as possible, thereby increasing a gap L (refer to FIG. 6) defined between the first bent portion 61*d* and the cleaning frame 51. Note that the position of the first bent portion 61*d* is determined in consideration of the head diameter of the screw 65 so as to avoid a rubber outflow range occurring in the forming of the elastic blade member 62 from the fixing surface.

According to the embodiment described above, the supporting sheet metal 61 can be made thinner as compared with the case of the conventional construction having the same strength. Thus, not only can the cleaning member be reduced in size, but also the cleaning device and the process cartridge can be miniaturized. In addition, though the cleaning member can be miniaturized, the strength can be ensured and hence the cleaning performance can be maintained.

(Removed Developer Containing Chamber)

Next, the removed developer containing chamber 55 as the removed developer containing portion will hereinafter be described with reference to FIGS. 2 and 6. Here, the removed developer containing chamber 55 serves to contain therein the residual developer which has been removed from the surface of the photosensitive drum 1 by the elastic blade 62.

As shown in FIGS. 2 and 6, in this embodiment, the removed developer containing chamber 55 constructed within the process cartridge 7 is constituted, as seen in its cross section, by a space defined by the cleaning frame 51, the cleaning blade 60 (including the supporting sheet metal 61 and the elastic blade 62), the filter 85, the photosensitive drum 1, and the flexible sheet member 80. At the opposite longitudinal ends of the removed developer containing chamber 55, elastic members (not shown) are affixed to the cleaning frame 51, and the resultant structure is made to abut against the photosensitive drum 1. Thus, the gaps are filled on the both end sides.

In this embodiment, the filter 85 is made of an elastic foaming member (e.g., Moltopren (registered trademark). The filter 85 allows passage of the air flow A from the inside of the removed developer containing chamber 55 to an outer side, and blocks passage of the removed developer. Note that the air flow A is caused by rotation of the photosensitive drum 1 (refer to FIG. 6).

In this embodiment, a carrying mechanism for carrying the removed developer is not provided within the removed developer containing chamber 55. As described above, the air flow A is caused within the removed developer containing chamber 55, thereby carrying the removed developer to the inner portion side of the removed developer containing chamber 55. In addition, the filter 85 is stuck to the extension portion 61*j* using a double coated tape or the like. Then, the cleaning blade 60 is attached to the cleaning frame 51. As a result, the filter 85 is positioned in a state in which the filter 85 is pressed against a pedestal 54 provided in the cleaning frame 51. Note that the filter 85 is disposed along the longitudinal direction of the extension portion 61*j* and the cleaning frame 51.

In this embodiment, the extension portion 61*j* is located at a position lower than the cleaning operation position C, i.e., an abutting portion in which the elastic blade member 62 abuts against the surface of the photosensitive drum 1, by a distance H (refer to FIG. 6). As a result, the space for the containing of the removed developer is effectively utilized, with the extension portion 61*j* extending off the space where the charging roller 2 is arranged. In this embodiment, the distance H is set to about 6 mm. Note that the distance H may fall within a range of 5 to 15 mm. In addition, the space constituting the removed developer containing chamber 55 is defined by the photosensitive drum 1, the cleaning frame 51, the cleaning member 60 and the sheet member 80. Here, the extension portion 61*j* constitutes a bottom surface of the removed developer containing chamber 55. Note that a part of the space constituting the removed developer containing chamber 55 may be defined by the cleaning frame 51, the supporting member 61 and the elastic blade 62 (the cleaning member 60).

According to the embodiment described above, the adoption of the above-mentioned construction makes it possible to increase the volume of removed developer which can be contained in the removed developer containing chamber as compared with the conventional art even if the height of the removed developer containing chamber is unchanged. In addition, the height of the removed developer containing chamber can be reduced as compared with a removed developer containing chamber having the same volume. Also, the reduction in the height of the removed developer containing chamber makes it possible to reduce the heights of the cleaning device and the process cartridge. Thus, the removed developer containing chamber, the cleaning device and the process cartridge can be miniaturized. Also, the cleaning member may serve as a part of the removed developer containing chamber, thereby realizing low-cost construction.

Second Embodiment

Figure 10B:
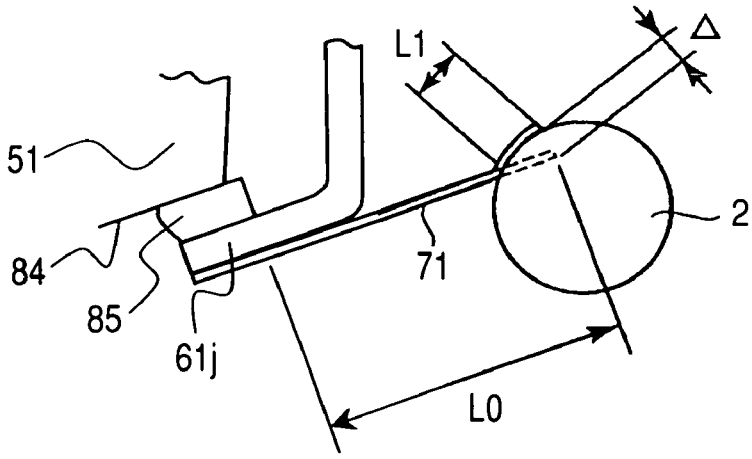

A second embodiment of the cleaning blade 60 to which the present invention is applied is shown in FIGS. 10A and 10B. Since the construction of the cleaning blade 60 of the second embodiment is the same as that of the cleaning blade 60 of the first embodiment, the constituent elements having the same operations as those in the first embodiment are designated with the same symbols, and the description of the first embodiment will apply to those elements.

In this embodiment, a rubbing member 70 (a charging roller cleaning member) adapted to contact the peripheral surface of the charging roller 2 is attached to the extension portion 61*j*.

The rubbing member 70 is constituted by an elastic sheet member 71. The elastic sheet member 71 is fixed to the surface of the extension portion 61*j* opposite to the surface of the extension portion 61*j* having the filter 85 attached thereto, by using a double coated tape (not shown). The elastic sheet member 71 is made of a polyimide film with a thickness of 25 to 75 μm.

That is, in a state in which the elastic sheet member 71 waves, some portion of the elastic sheet member 71 may not abut against the charging roller 2 when the charging roller 2 is attached, and hence the cleaning for the charging roller 2 may become imperfect.

As shown in FIG. 10B, in the case of this embodiment, a free length L0 of the elastic sheet member 71 is set in a range of 6 to 10 mm, an abutting length L1 of the elastic sheet member 71 against the charging roller 2 is set in a range of 2 to 8 mm, and an inroad amount Δ of the elastic sheet member 71 into the charging roller 2 is set in a range of 2 to 4 mm. Here, the inroad amount Δ, in terms of a design, means the shortest distance between a free end tip portion of the elastic sheet member 71 extending toward the charging roller 2 and the outer periphery of the charging roller 2.

The angle θ2 of the extension portion 61*j* is in the range as described above. The elastic sheet member 71 is directly attached to the extension portion 61*j* without providing a pedestal or the like in the cleaning frame 51, thereby satisfying the above-mentioned conditions. Thus, the elastic sheet member 71 is attached so as not to wave in a direction of an axis of the photosensitive drum 1, i.e., so as not to have irregularities at its tip portion.

According to the constitution of this embodiment, the peripheral surface of the charging roller 2 can be cleaned and thus the image quality is stabilized.

Note that while in the embodiments described above the developer image formed on the surface of the photosensitive drum 1 is transferred onto the recording medium S, it is also possible to adopt a constitution in which the developer image formed on the surface of the photosensitive drum 1 is temporarily transferred onto an intermediate transfer member, and the developer image is then transferred from the intermediate transfer member onto the recording medium S. The present invention can be similarly applied to the image forming apparatus having such a construction, and in this case as well, the same operations and effects can be obtained.

Note that while the above-mentioned embodiments are directed to an example of the cleaning device provided in the process cartridge, the cleaning device may be independently provided. Thus, the cleaning device which is independently provided may be provided in the electrophotographic image forming apparatus.

According to the present invention, the volume of the removed developer containing portion for containing therein the removed developer can be made larger than that of a conventional one even if the removed developer containing portion is unchanged.

In addition, according to the present invention, the height of the removed developer containing portion can be reduced as compared with a removed developer containing portion having the same container volume.

In addition, according to the present invention, the reduction in the height of the removed developer containing portion makes it possible to reduce the heights of the cleaning device and the process cartridge. As a result, the miniaturization of the removed developer containing portion, and the cleaning device and the process cartridge can be realized.

Also, according to the present invention, the supporting member is bent at a plurality of locations, thereby allowing the strength of the supporting member to be enhanced.

Moreover, according to the present invention, the removed developer containing portion for containing therein the removed developer can be constructed inside the supporting member on the opposite side as that of the attachment surface of the supporting member where the supporting member is attached to the cleaning frame, by using the extension portion.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-134643 filed Apr. 28, 2004, Japanese Patent Application No. 2004-274205 filed Sep. 21, 2004, and Japanese Patent Application No. 2004-129672 filed Apr. 26, 2004, which are hereby incorporated by reference herein.

What is claimed is:

1. A cleaning device to be used in an electrophotographic image forming apparatus, for removing a developer remaining on an electrophotographic photosensitive drum from the photosensitive drum, said cleaning device comprising:

a frame;

an elastic blade configured and positioned to elastically contact the photosensitive drum to remove the developer remaining on the photosensitive drum from the photosensitive drum;

a supporting member configured and positioned to support said elastic blade, said supporting member comprising:

a supporting portion to which said elastic blade is attached for supporting said elastic blade, said supporting portion being attached to said frame;

a first bent portion which is bent from said supporting portion to an opposite side of said supporting member opposite to an attachment surface where said supporting portion is attached to said frame, in an orthogonal direction orthogonal to said supporting portion;

a connecting portion which extends from said first bent portion to the opposite side in the orthogonal direction;

a second bent portion which is bent from said connecting portion to a side of said supporting member opposite to a side where said elastic blade is provided, in the orthogonal direction and in a lateral direction of said supporting portion; and an extension portion which extends from said second bent portion to the side opposite to the side where said elastic blade is provided, in the orthogonal direction and in the lateral direction;

a removed developer containing portion configured and positioned to contain the developer removed from the photosensitive drum by said elastic blade, said removed developer containing portion being partially constituted by said elastic blade and said supporting member; and a filter disposed between said extension portion and said frame along a longitudinal direction of said extension portion and said frame, said filter allowing passage of an air flow from said removed developer containing portion to an outer side and blocking passage of the removed developer, wherein the air flow within said removed developer containing portion is vented to an outside of said removed developer containing portion through said filter.

2. A cleaning device according to claim 1, further comprising a rubbing member attached to said extension portion, said rubbing member being configured and positioned to rub a peripheral surface of a charging roller that charges the photosensitive drum.

3. A cleaning device according to claim 1 or 2, wherein said cleaning device is mounted to a main body of the electrophotographic image forming apparatus such that said supporting portion is substantially horizontally disposed, wherein said connecting portion and said extension portion extend downwardly, and wherein said extension portion is disposed at a position vertically lower than a cleaning operation position where said elastic blade contacts the electrophotographic photosensitive drum.

4. A process cartridge detachably mountable to a main body of an electrophotographic image forming apparatus, said process cartridge comprising:

(i) an electrophotographic photosensitive drum; and (ii) a cleaning device configured and positioned to remove a developer remaining on said photosensitive drum from said photosensitive drum, said cleaning device comprising:

a frame;

an elastic blade configured and positioned to elastically contact said photosensitive drum to remove the developer remaining on said photosensitive drum from said photosensitive drum;

a supporting member configured and positioned to support said elastic blade, said supporting member comprising:

a supporting portion to which said elastic blade is attached to support said elastic blade, said supporting portion being attached to said frame;

a first bent portion which is bent from said supporting portion to an opposite side of said supporting member opposite to an attachment surface where said supporting portion is attached to said frame, in an orthogonal direction orthogonal to said supporting portion;

a connecting portion which extends from said first bent portion to the opposite side in the orthogonal direction;

a second bent portion which is bent from said connecting portion to a side of said supporting member opposite to a side where said elastic blade is provided, in the orthogonal direction and in a lateral direction of said supporting portion; and an extension portion which extends from said second bent portion to the side opposite to the side where said elastic blade is provided, in the orthogonal direction and in the lateral direction;

a removed developer containing portion configured and positioned to contain the developer removed from said photosensitive drum by said elastic blade, said removed developer containing portion being partially constituted by said elastic blade and said supporting member; and a filter disposed between said extension portion and said frame along a longitudinal direction of said extension portion and said frame, said filter allowing passage of an air flow from said removed developer containing portion to an outer side and blocking passage of the removed developer, wherein the air flow within said removed developer containing portion is vented to an outside of said removed developer containing portion through said filter.

5. A process cartridge according to claim 4, further comprising a rubbing member attached to said extension portion, said rubbing member being configured and positioned to rub a peripheral surface of a charging roller that charges said photosensitive drum.

6. A process cartridge according to claim 4 or 5, wherein said process cartridge is mounted to a main body of the electrophotographic image forming apparatus such that said supporting portion is substantially horizontally disposed, wherein said connecting portion and said extension portion extend downwardly, and wherein said extension portion is disposed at a position vertically lower than a cleaning operation position where said elastic blade contacts said electrophotographic photosensitive drum.

7. A cleaning member to be used in a process cartridge that is detachably mountable to a main body of an electrophotographic image forming apparatus, for removing a developer remaining on an electrophotographic photosensitive drum from the photosensitive drum, said cleaning member comprising:

an elastic blade configured and positioned to elastically contact the photosensitive drum to remove the developer remaining on the photosensitive drum from the photosensitive drum; and a supporting member configured and positioned to support said elastic blade, said supporting member comprising:

a supporting portion to which said elastic blade is attached to support said elastic blade, said supporting portion being attached to the process cartridge;

a first bent portion which is bent from said supporting portion to an opposite side of said supporting member opposite to an attachment surface where said supporting portion is attached to the process cartridge, in an orthogonal direction orthogonal to said supporting portion;

a connecting portion which extends from said first bent portion to the opposite side in the orthogonal direction;

a second bent portion which is bent from said connecting portion to a side of said supporting member opposite to a side where said elastic blade is provided, in the orthogonal direction and in a lateral direction of said supporting portion; and an extension portion which extends from said second bent portion to the side opposite to the side where said elastic blade is provided, in the orthogonal direction and in the lateral direction, wherein when said cleaning member is attached to the process cartridge, said elastic blade and said supporting member constitute a part of a removed developer containing portion configured and positioned to contain the developer removed from the photosensitive drum by said elastic blade; and a filter disposed between said extension portion and said frame along a longitudinal direction of said extension portion and said frame, said filter allowing passage of an air flow from the removed developer containing portion to an outer side and blocking passage of the removed developer, wherein the air flow within the removed developer containing portion is vented to an outside of the removed developer containing portion through said filter.

8. A cleaning member according to claim 7, further comprising a rubbing member attached to said extension portion, said rubbing member being configured and positioned to rub a peripheral surface of a charging roller that charges the photosensitive drum when said cleaning member is attached to the process cartridge.

9. An electrophotographic image forming apparatus for forming an image on a recording medium, comprising:

(i) an electrophotographic photosensitive drum;

(ii) a cleaning device configured and positioned to remove a developer remaining on said electrophotographic photosensitive drum from said photosensitive drum, said cleaning device comprising:

a frame;

an elastic blade configured and positioned to elastically contact said photosensitive drum to remove the developer remaining on said photosensitive drum from said photosensitive drum;

a supporting member configured and positioned to support said elastic blade, said supporting member comprising:

a supporting portion to which said elastic blade is attached for supporting said elastic blade, said supporting portion being attached to said frame;

a first bent portion which is bent from said supporting portion to an opposite side of said supporting member opposite to an attachment surface where said supporting portion is attached to said frame, in an orthogonal direction orthogonal to said supporting portion;

a connecting portion which extends from said first bent portion to the opposite side in the orthogonal direction;

a second bent portion which is bent from said connecting portion to a side of said supporting member opposite to a side where said elastic blade is provided, in the orthogonal direction and in a lateral direction of said supporting portion; and an extension portion which extends from said second bent portion to the side opposite to the side where said elastic blade is provided, in the orthogonal direction and in the lateral direction;

a removed developer containing portion configured and positioned to contain the developer removed from said photosensitive drum by said elastic blade, said removed developer containing portion being partially constituted by said elastic blade and said supporting member; and a filter disposed between said extension portion and said frame along a longitudinal direction of said extension portion and said frame, said filter allowing passage of an air flow from said removed developer containing portion to an outer side and blocking passage of the removed developer, wherein the air flow within said removed developer containing portion is vented to an outside of said removed developer containing portion through said filter; and (iii) conveying means for conveying the recording medium.

10. An electrophotographic image forming apparatus for forming an image on a recording medium, comprising:

(i) a process cartridge detachably mounted on a mounting portion of said electrophotographic image forming apparatus, said process cartridge comprising:

an electrophotographic photosensitive drum;

a cleaning device configured and positioned to remove a developer remaining on said electrophotographic photosensitive drum, said cleaning device comprising:

a frame;

an elastic blade configured and positioned to elastically contact said photosensitive drum to remove the developer remaining on said photosensitive drum from said photosensitive drum;

a supporting member configured and positioned to support said elastic blade, said supporting member comprising:

a supporting portion to which said elastic blade is attached for supporting said elastic blade, said supporting portion being attached to said frame;

a first bent portion which is bent from said supporting portion to an opposite side of said supporting member opposite to an attachment surface where said supporting portion is attached to said frame, in an orthogonal direction orthogonal to said supporting portion;

a connecting portion which extends from said first bent portion to the opposite side in the orthogonal direction;

a second bent portion which is bent from said connecting portion to a side of said supporting member opposite to a side where said elastic blade is provided, in the orthogonal direction and in a lateral direction of the supporting portion; and an extension portion which extends from said second bent portion to the side opposite to the side where said elastic blade is provided, in the orthogonal direction and in the lateral direction;

a removed developer containing portion configured and positioned to contain the developer removed from said photosensitive drum by said elastic blade, said removed developer containing portion being partially constituted by said elastic blade and said supporting member; and a filter disposed between said extension portion and said frame along a longitudinal direction of said extension portion and said frame, said filter allowing passage of an air flow from said removed developer containing portion to an outer side and blocking passage of the removed developer, wherein the air flow within said removed developer containing portion is vented to an outside of said removed developer containing portion through said filter; and (ii) conveying means for conveying the recording medium.

* * * * *

UNITED STATES PATENT AND TRADEMARK OFFICE

CERTIFICATE OF CORRECTION

PATENT NO. : 7,158,749 B2
APPLICATION NO. : 10/957701
DATED : January 2, 2007
INVENTOR(S) : Takahito Ueno et al.

It is certified that error appears in the above-identified patent and that said Letters Patent is hereby corrected as shown below:

ON THE TITLE PAGE, AT ITEM (56), References Cited:
Page 2, U.S. Patent Documents, "6,577,831 B1 6/2003 Numagami et al." should read --6,577,831 B1 6/2003 Kojima et al.--.

COLUMN 4:
Line 34, "hotosensitive" should read --photosensitive--.

COLUMN 12:
Line 7, "trademark)." should read --trademark)).--.

Signed and Sealed this

Twenty-second Day of July, 2008

JON W. DUDAS
*Director of the United States Patent and Trademark Office*